US007891113B2

(12) United States Patent
Oh et al.

(10) Patent No.: US 7,891,113 B2
(45) Date of Patent: Feb. 22, 2011

(54) CLOGGING DEGREE DECIDING METHOD FOR DRYER

(75) Inventors: Chang Hun Oh, Changwon-si (KR); Seon Il Heo, Changwon-si (KR); Yang Hwan Kim, Changwon-si (KR); Yeon Sik Choi, Changwon-si (KR); Seog Ho Ko, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 171 days.

(21) Appl. No.: 12/104,679

(22) Filed: Apr. 17, 2008

(65) Prior Publication Data

US 2008/0313923 A1 Dec. 25, 2008

(30) Foreign Application Priority Data

Apr. 18, 2007 (KR) ..... 10-2007-0038073

(51) Int. Cl.
*D06F 58/28* (2006.01)

(52) U.S. Cl. ..... 34/282; 34/88

(58) Field of Classification Search ..... 34/480, 34/524, 72, 82, 88, 282
See application file for complete search history.

(56) References Cited

U.S. PATENT DOCUMENTS

| | | | | |
|---|---|---|---|---|
| 5,291,667 | A | | 3/1994 | Joslin et al. |
| 5,925,321 | A | * | 7/1999 | Koyamoto et al. ..... 422/122 |
| 6,792,694 | B2 | | 9/2004 | Lapierre |

FOREIGN PATENT DOCUMENTS

| | | | | |
|---|---|---|---|---|
| DE | 102007042060 | | | 3/2008 |
| DE | 102007062070 | | | 7/2008 |
| JP | 02203132 | A | * | 8/1990 |
| JP | 2000246000 | A | * | 9/2000 |
| KR | 10-0506593 | B1 | | 7/2005 |
| KR | 10-2006-0036726 | | * | 5/2006 |
| KR | 10-0651864 | B1 | | 11/2006 |
| KR | 10-0735963 | B1 | | 6/2007 |
| KR | 10-0783229 | B1 | | 11/2007 |

OTHER PUBLICATIONS

Machine translation of KR 10-2006-0036726.*
Korean Decision to Grant a Patent dated Aug. 21, 2008 for Application No. 10-2007-0038073.
German Office Action with translation dated Jul. 6, 2010.
Australian Office Action dated Aug. 10, 2010.

* cited by examiner

*Primary Examiner*—Jiping Lu
(74) *Attorney, Agent, or Firm*—Ked & Associates LLP

(57) ABSTRACT

A clogging degree deciding method for a dryer, which can accurately determine a clogging degree of an air passage, even when there is an influence of external environments, is disclosed. The clogging degree deciding method includes reading information as to clogging of an air passage, and displaying a clogging degree of an exhaust duct or a clogging degree of a filter in accordance with the read clogging information. The clogging information includes an ON/OFF duty ratio of a temperature control member. The displaying step includes comparing a difference between two ON/Off duty ratios finally stored with a filter-clogging determination reference value, and determining the clogging degree of the filter, based on a result of the comparison. Accordingly, it is possible to provide the clogging degrees of the exhaust duct and filter to the user.

10 Claims, 10 Drawing Sheets

[FIG1]

[FIG3]
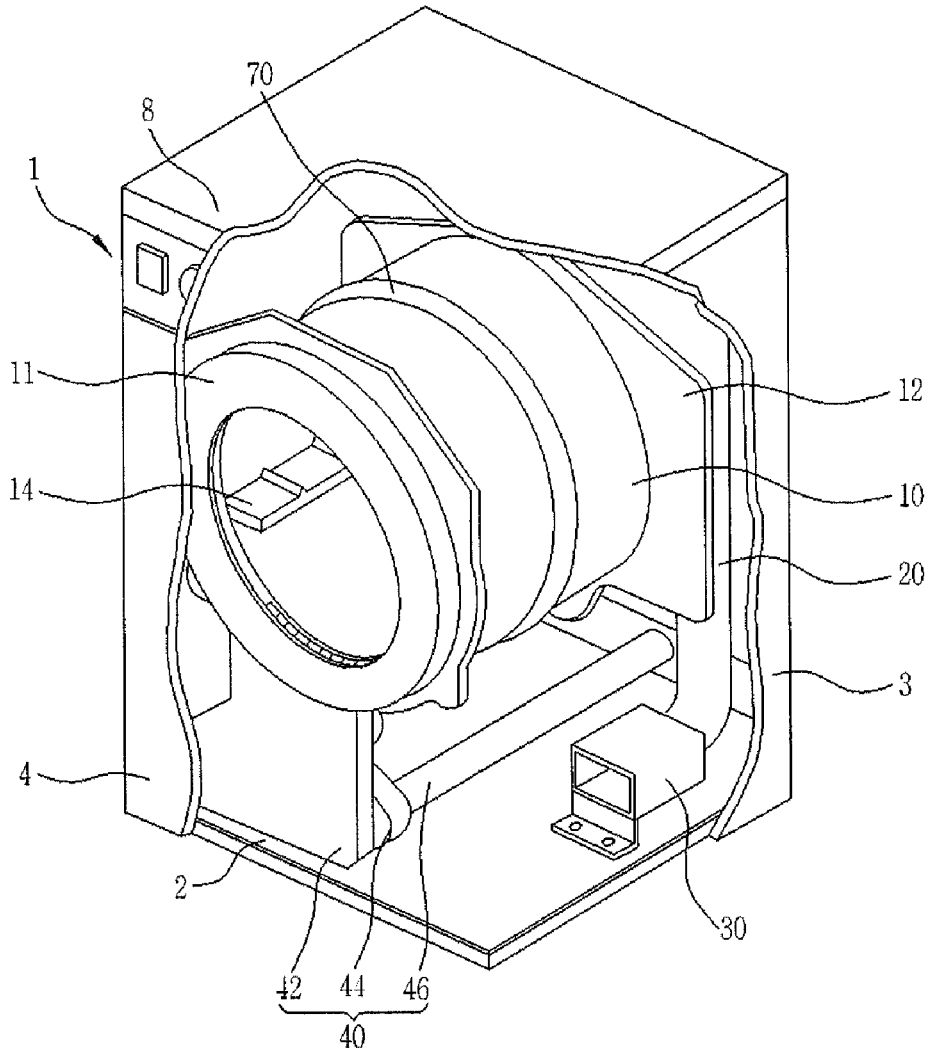

[FIG4]
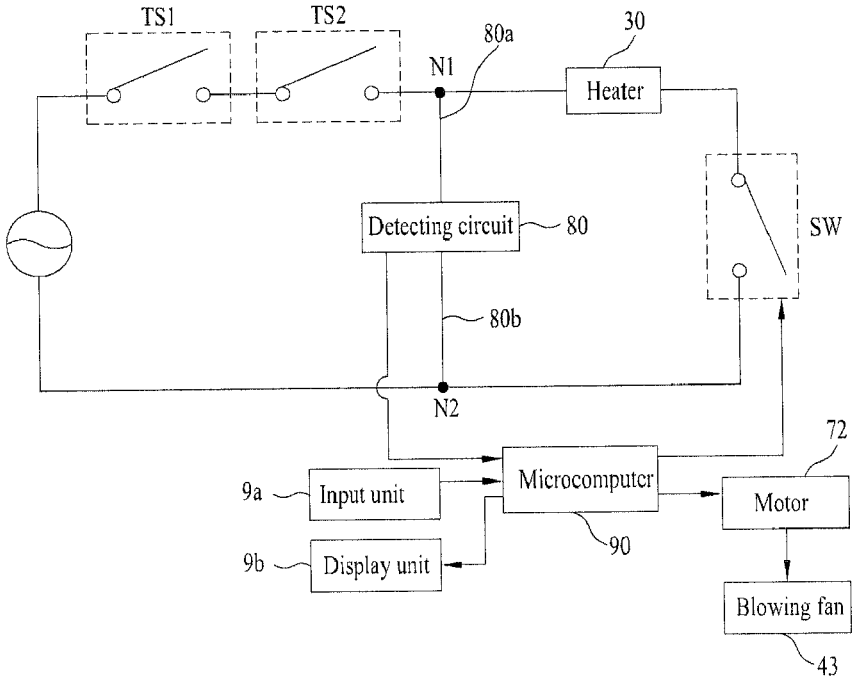
[FIG5]
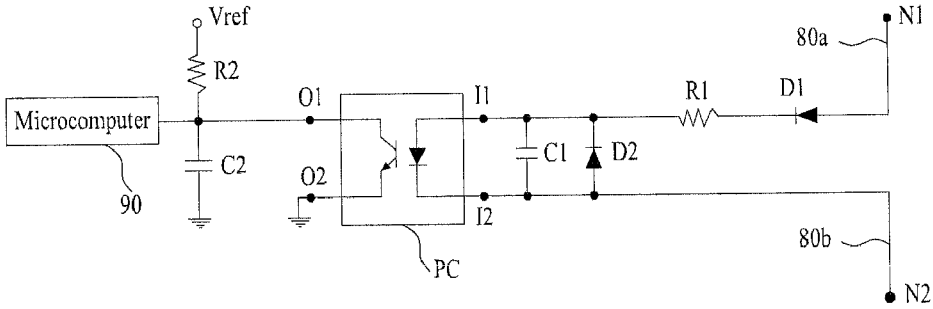

[FIG6]
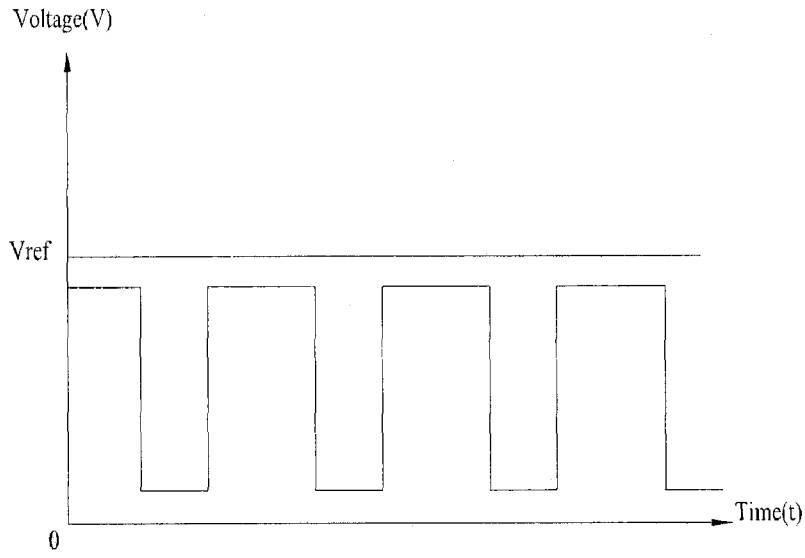
[FIG7]
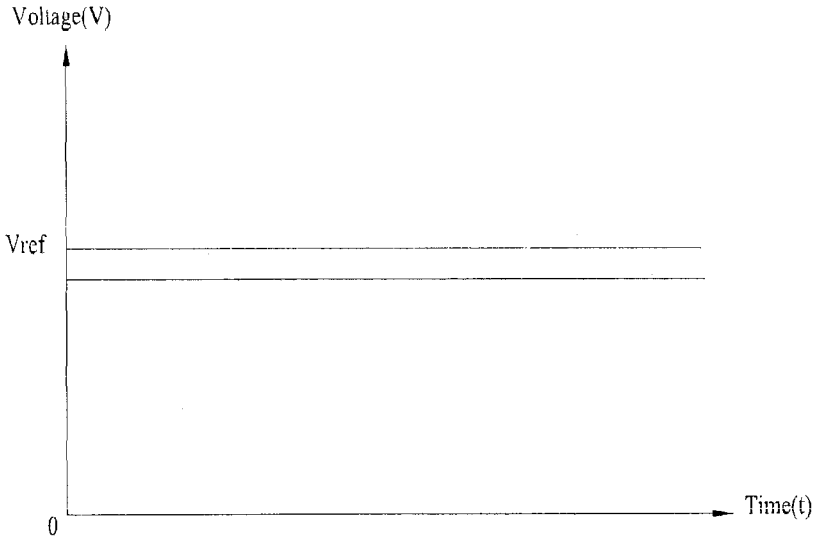

[FIG8]
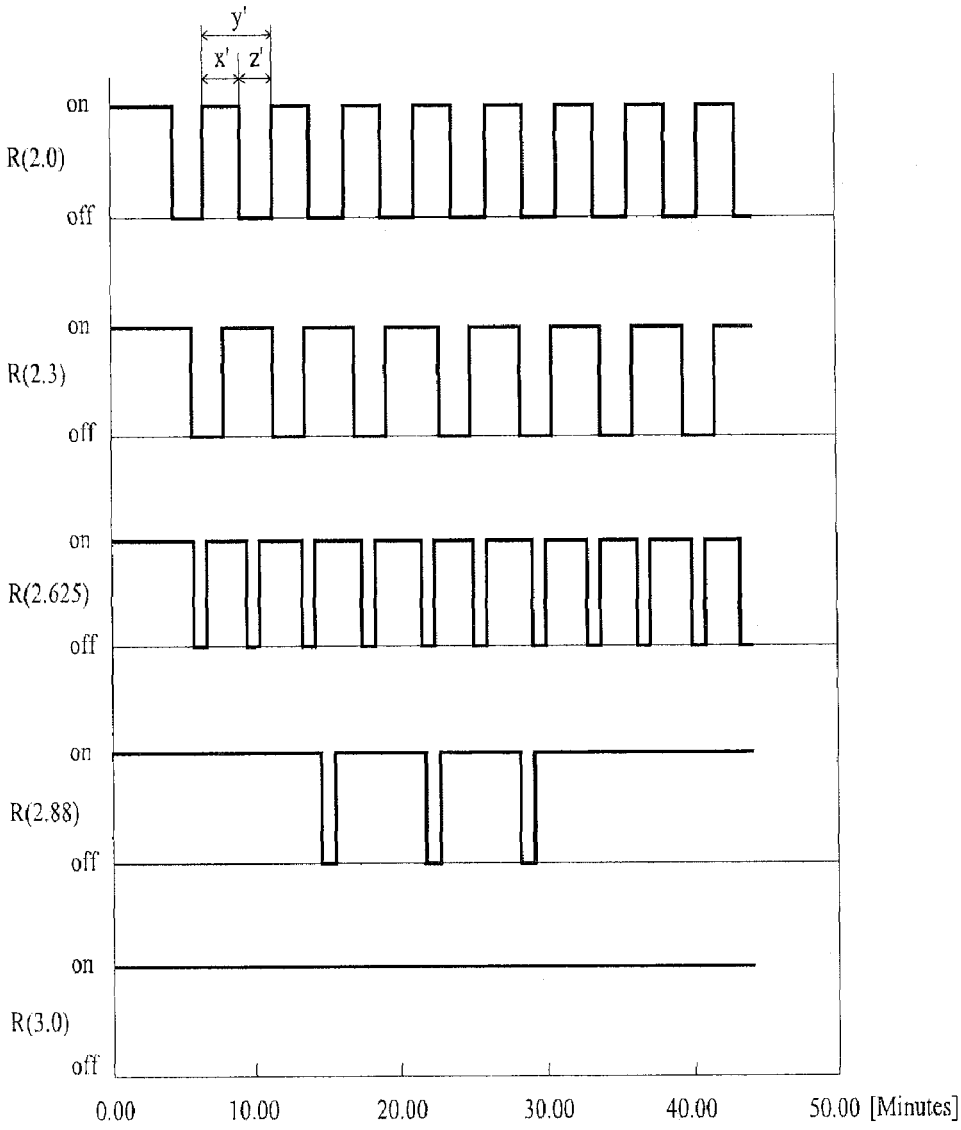

[FIG9]
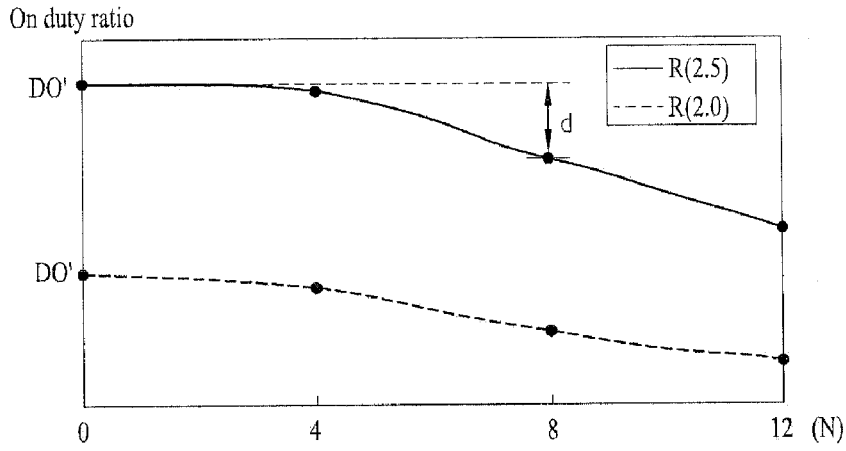
[FIG10]
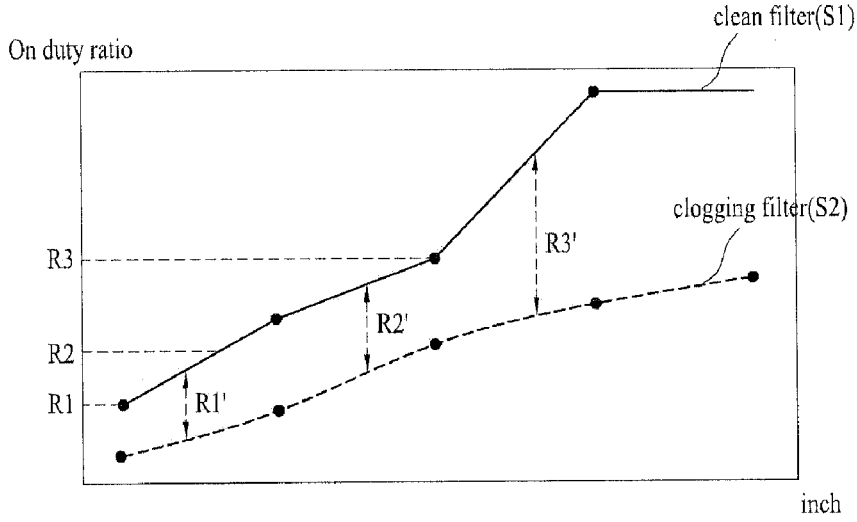

[FIG11]
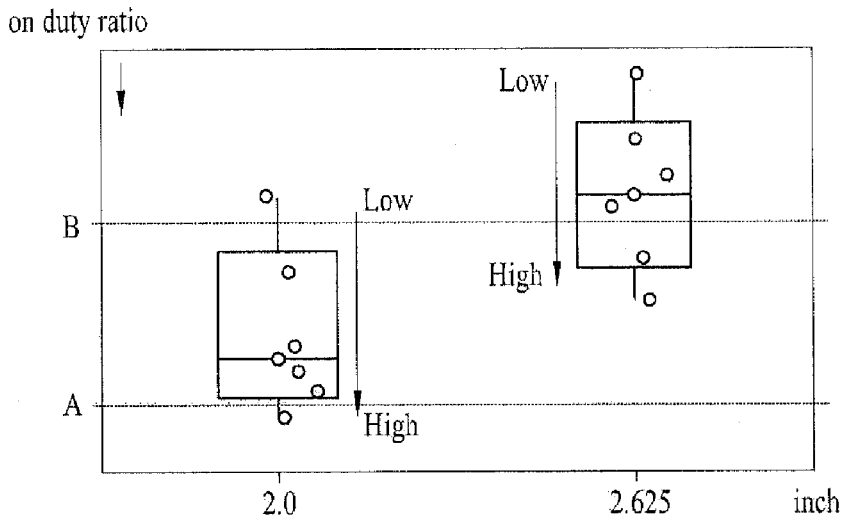
[FIG12]
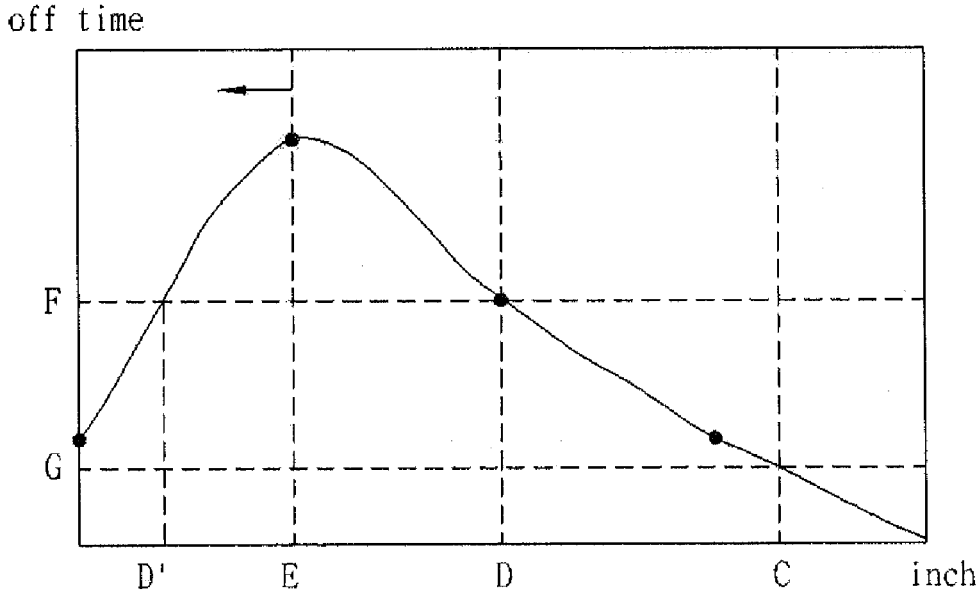

[FIG13]
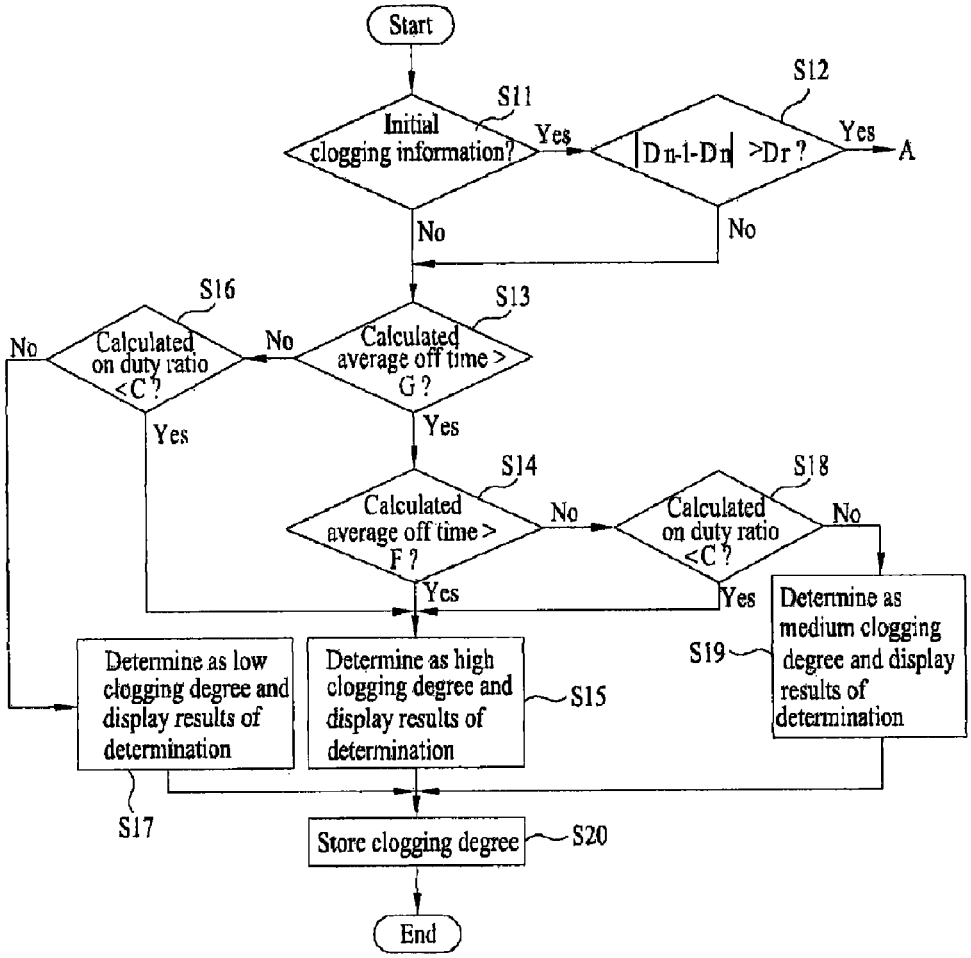

[FIG14]
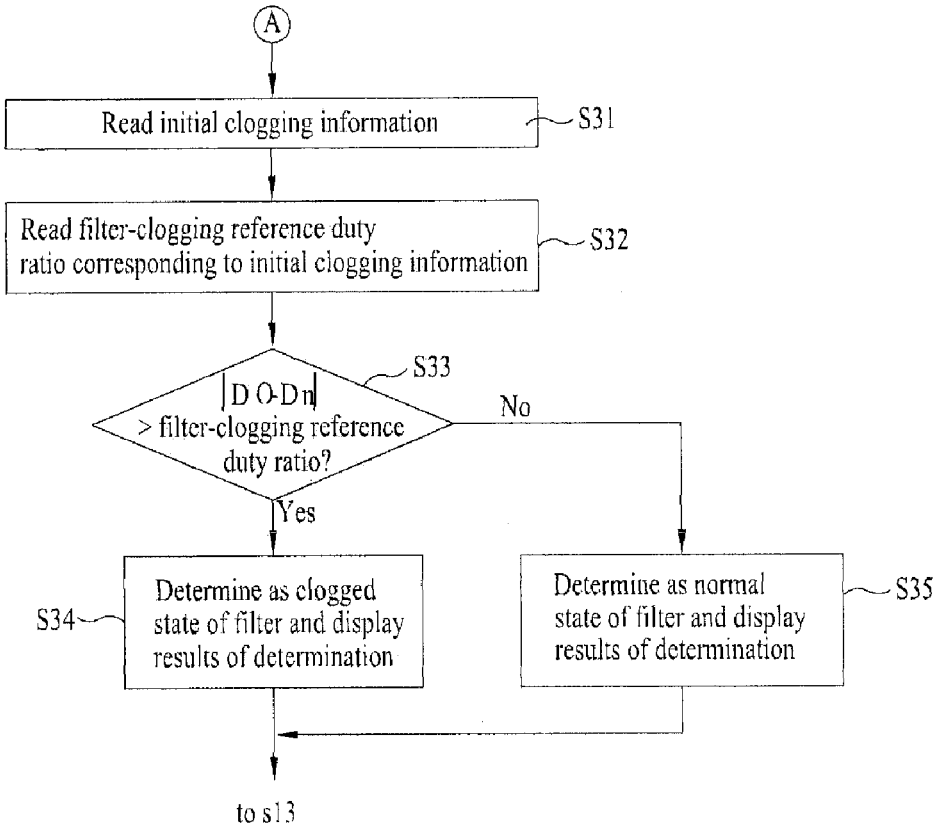

CLOGGING DEGREE DECIDING METHOD FOR DRYER

This application claims the benefit of Korean Patent Application No. 10-2007-0038073, filed on Apr. 18, 2007, which is hereby incorporated by reference as if fully set forth herein.

BACKGROUND OF THE INVENTION

1. Field of the Invention

The present invention relates to a dryer, and more particularly to a clogging degree deciding method for a dryer, which can accurately determine a clogging degree of an air passage, even when there is an influence of external environments.

2. Discussion of the Related Art

Generally, a washing machine includes a body having a certain shape, a drum installed in the body, and a tub arranged to surround the drum. Wash water is collected in the tub. The washing machine also includes a drive motor for rotating the drum, a detergent box for supplying a detergent, a water supply pipe connected to the detergent box, to supply wash water alone or in a state of being mixed with the detergent supplied from the detergent box, and a drainage pipe for outwardly draining wash water used in a washing cycle. The washing machine further includes a pump and drainage hose, which are connected to an outer end of the drainage pipe, to forcibly drain the wash water.

The above-mentioned washing machine performs a washing operation using friction generated between laundry and wash water in the drum when the laundry falls by gravity during rotation of the drum. Recently, drum washing machines with various additional functions have been developed. For example, a drum washing machine, which has a drying function, not only to wash laundry, but also to dry laundry using hot air, has been developed.

Washing machines, which have a drying function as described above, are classified into a condensation type and an exhaustion type. In a condensation type washing machine, hot air generated from a heater is supplied to a drum by a blowing fan, to dry laundry contained in the drum. In this case, the air used to dry the laundry in the drum is in a hot and high-humid state. The air then flows to an air outlet communicating with a tub. At one side of the air outlet, a nozzle is arranged to inject cold water. By the nozzle, moisture is removed from the hot and high-humid air, to generate dry air, which is, in turn, supplied to the blowing fan.

In an exhaustion type washing machine, hot air generated from a heater and blown by a blowing fan flows to pass through laundry contained in a drum. The hot air is then exhausted to the outside of the washing machine through an exhaust port formed at one side of the washing machine. The exhaust port is connected to a bellows tube connected to a tub. The exhaust port also functions as a breath port when a baby or pet is confined in the washing machine.

In the washing machine, which has the above-mentioned exhaustion type drying function, lint may be produced from laundry during a drying operation. The lint is discharged to the outside of the washing machine through the exhaust port after circulating through the drum along with the hot air.

In order to prevent lint produced from laundry from being accumulated in the exhaust port, which functions to discharge lint to the outside of the washing machine, a structure capable of periodically collecting and removing lint is provided. For example, a lint filter is mounted in the exhaust port, in order to prevent the exhaust port from being clogged by lint when the washing machine is used for a prolonged period of time.

For the simplicity of description, the above-mentioned drying machines, which have a drying function, will be simply referred to as "dryers".

In the above-mentioned conventional dryer, the exhaust port extends through an outer wall. However, the installer of the dryer does not perform a procedure for identifying the initial state of the exhaust port (namely, the state of the exhaust port in a formation stage thereof). For this reason, the determination as to whether or not the exhaust port satisfies minimum conditions for a desired operation of the dryer is simply made by the installer's determination.

Such a conventional dryer recommends for the user to clean the filter whenever the dryer is used. However, the user may frequently neglect the filter cleaning due to inconvenience and troublesome caused by the cleaning. In this case, the clogging degree of the filter increases as the drying operation is repeated. For this reason, an increase in drying time and an increase in power consumption may occur. When the clogging degree is excessive, lint may float in the drum without being collected by the filter, and may then be attached to the laundry and the inner surface of the dryer. In this case, the laundry may be contaminated by the lint. Furthermore, in the exhaustion type dryer, lint may be accumulated in the exhaust port functioning to exhaust air, which has been used to dry laundry, to the outside of the dryer, so that the lint may interfere with a flow of air. In this case, it is very difficult for the user to recognize such clogging of the exhaust port.

Furthermore, in the conventional dryer, it is possible to determine or identity only the clogging of the exhaust port. The conventional dryer cannot provide any information as to the current clogging degree of the exhaust port or air passage.

SUMMARY OF THE INVENTION

Accordingly, the present invention is directed to a clogging degree deciding method for a dryer that substantially obviates one or more problems due to limitations and disadvantages of the related art.

An object of the present invention is to provide a clogging degree deciding method for a dryer, which can more accurately determine the clogging degree of an air passage.

Another object of the present invention is to provide a clogging degree deciding method for a dryer, which can identify information as to the current clogging state of an air passage and a clogged portion of the air passage, and can display the information while providing the information to the user.

Another object of the present invention is to provide a clogging degree deciding method for a dryer, which can decide the clogging degree of the dryer in accordance with the execution of a drying operation or a variation in environment such as house-moving or cleaning.

Another object of the present invention is to provide a clogging degree deciding method for a dryer, which can accurately determine the clogging degree of an air passage even when the environment around the dryer varies, for example, even when power applied to the dryer varies.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a clogging degree deciding method for a dryer comprises: reading information as to clogging of an air passage; and displaying a clogging degree of an exhaust duct or a clogging degree of a filter in accordance with the read clogging information, wherein the clogging information comprises an ON/OFF duty ratio of a temperature control member, wherein the displaying comprise comparing a difference between two ON/Off duty ratios finally stored with a filter-clogging determination reference value, and determining the clogging degree of the filter, based on a result of the comparison.

The clogging degree deciding method may further comprise calculating the ON/OFF duty ratio of the temperature control member during a drying operation.

The clogging information may further comprise an initial clogging degree of the exhaust duct. The step of determining the clogging degree of the filter may comprise comparing the calculated ON/OFF duty ratio difference with a filter-clogging reference duty ratio corresponding to the initial clogging degree, and determining the clogging degree of the filter, based on a result of the comparison.

The clogging degree deciding method may further comprise determining the clogging degree of the exhaust duct.

The step of determining the clogging degree of the exhaust duct may be executed when there is no information stored as to clogging of the exhaust duct.

The step of determining the clogging degree of the exhaust duct may comprise calculating an average ON/OFF time of the temperature control member during a drying operation of the dryer, and primarily comparing the calculated average ON/OFF time with at least one of first and second reference values.

The step of determining the clogging degree of the exhaust duct may comprise calculating the ON/OFF duty ratio of the temperature control member, based on a result of the primary comparison, and secondarily comparing the calculated ON/OFF duty ratio with a clogging determination reference value for the exhaust duct.

In another aspect of the present invention, a clogging degree deciding method for a dryer comprises: staring a drying operation; primarily calculating an average ON/OFF time of a temperature control member during a drying operation; secondarily calculating an ON/OFF duty ratio of the temperature control member during the drying operation when the calculated ON/OFF time is within a predetermined range; primarily determining a clogging degree of an air passage, based on the calculated ON/OFF duty ratio; and secondarily determining the clogging degree of the air passage, based on the calculated ON/OFF time, when the calculated ON/OFF time is outside the predetermined range.

The clogging degree of the air passages may correspond to about a clogging degree of an exhaust duct.

The clogging degree deciding method may further comprise displaying the clogging degree of the air passage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 3 is a partially-broken perspective view of the dryer according to the present invention;

FIG. 4 is a circuit configuration of the dryer, to which a clogging detecting method according to the present invention is applied;

FIG. 5 is a circuit diagram illustrating an exemplary embodiment of a detecting circuit shown in FIG. 4;

FIGS. 6 and 7 are waveform diagrams of outputs from the detecting circuit;

FIG. 8 is a waveform diagram depicting waveforms of detect signals recognized by a microcomputer;

FIG. 9 is a graph depicting a variation in clogging degree depending on a variation in the diameter of an exhaust duct and a variation in the number of use times of the dryer;

FIG. 10 is a graph depicting a variation in the clogging degree of a lint filter depending on a variation in the diameter of the exhaust duct;

FIG. 11 is a graph depicting a variation in the clogging degree calculated based on a variation in the applied voltage;

FIG. 12 is a graph depicting a variation in average OFF time depending on a variation in the diameter of the exhaust duct;

FIG. 13 is a main flow chart of a clogging degree deciding method for the dryer according to the present invention; and FIG. 14 is a sub flow chart of FIG. 13.

DETAILED DESCRIPTION OF THE INVENTION

Reference will now be made in detail to the preferred embodiments of the present invention associated with, for example, a dryer, examples of which are illustrated in the accompanying drawings. However, the scope of the present invention is not limited to the following embodiments and drawings. The scope of the present invention is limited only to the contents defined in the claims, which will be described later.

Figure 1:
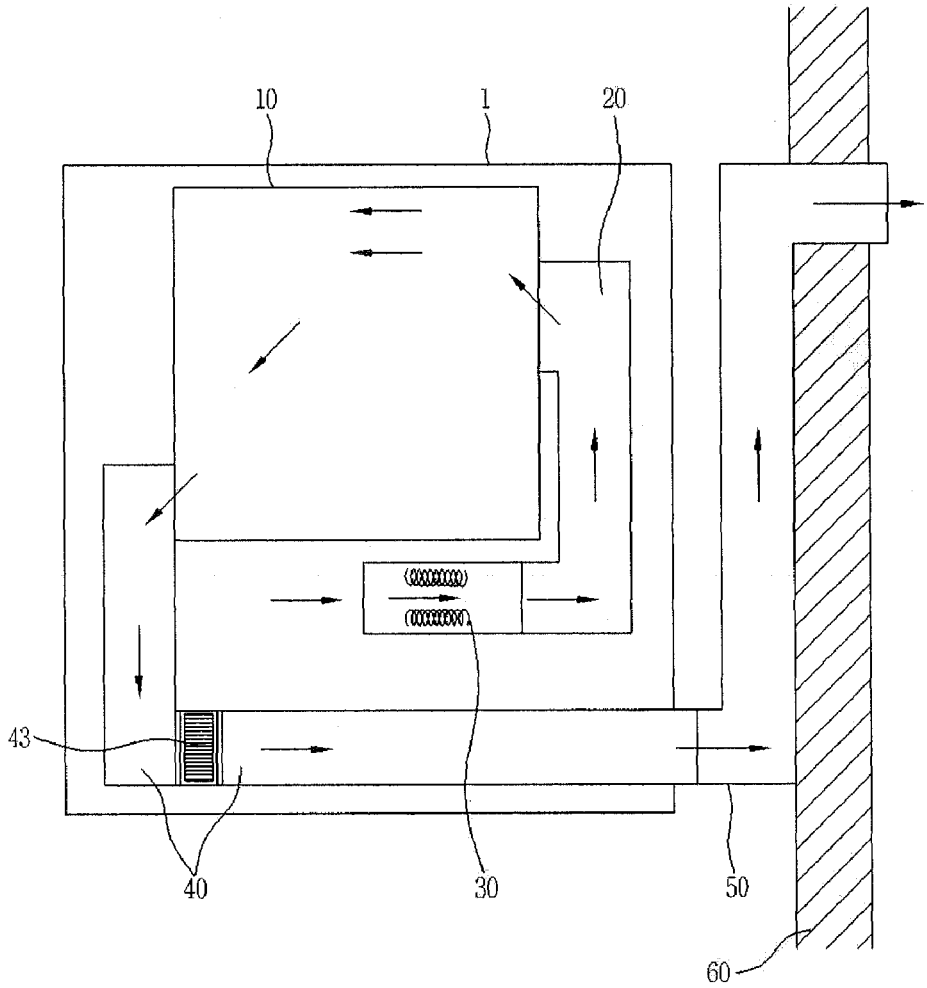
FIG. 1 is a sectional view of a dryer according to the present invention.
Figure 2:
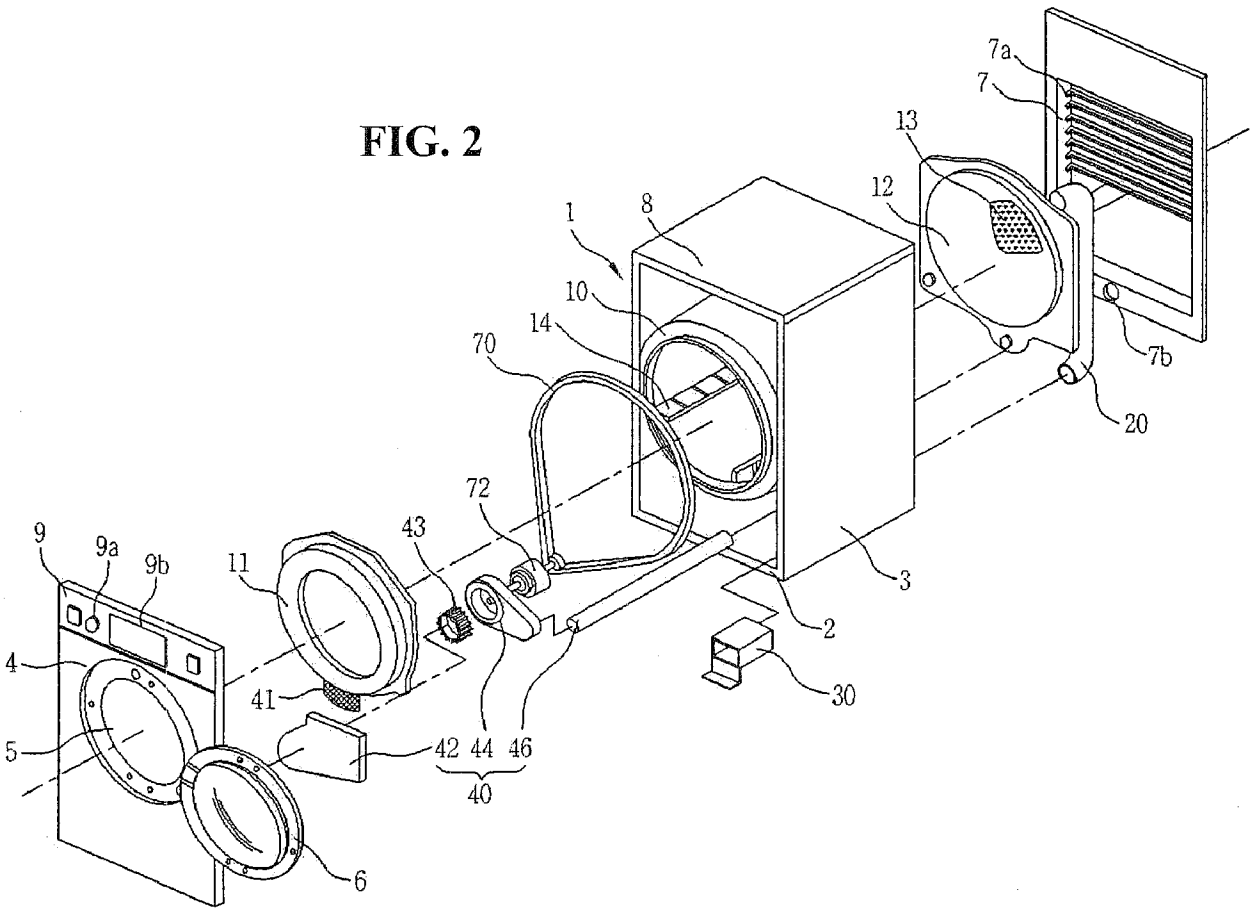
FIG. 2 is an exploded perspective view of the dryer according to the present invention.

FIG. 1 is a sectional view of a dryer according to the present invention. FIG. 2 is an exploded perspective view of the dryer according to the present invention. FIG. 3 is a partially-broken perspective view of the dryer according to the present invention. The following description will be given in conjunction with an embodiment in which the present invention is applied to an exhaustion type dryer. However, the present invention is not limited to the exhaustion type dryer.

As shown in FIG. 1, the exhaustion type dryer according to the illustrated embodiment includes a cabinet 1, a drum 10 arranged in the cabinet 1, to contain laundry, a suction passage 20 formed to suck air into the drum 10, a heater 30 arranged in the suction passage 20, and an exhaust passage 40 formed to exhaust the air emerging from the drum 10 to the outside of the cabinet 1. In the case of this exhaustion type dryer, an external exhaust duct 50, which extends through an inner wall 60 of a building, is connected to the exhaust passage 40, to outwardly exhaust the air.

A blowing fan 43 is arranged in one of the suction passage 20 and exhaust passage 40. The following description will be given only in conjunction with the case in which the blowing fan 43 is arranged in the exhaust passage 40.

As shown in FIGS. 2 and 3, the cabinet 1 includes a base panel 2, a cabinet body 3 installed on the base panel 2, a cabinet cover 4 mounted to a front side of the cabinet body 3, a back panel 7 mounted to a back side of the cabinet body 3, and a top cover 8 mounted to a top side of the cabinet body 3. The cabinet 1 also includes a control panel 9 mounted to an upper end portion of the cabinet cover 4.

As shown in FIG. 2, a laundry loading/unloading hole 5 is formed through the cabinet cover 4. A door 6 is pivotally connected to the cabinet cover 4, in order to open or close the laundry loading/unloading hole 5. The control panel 9, which is mounted to the upper end portion of the cabinet cover 4, includes an input unit 9*a* for acquiring an input from the user, and a display unit 9*b* for displaying a state of the dryer (including, for example, a drying operation progress, a drying degree, a residual drying time, a selected drying mode, etc.). A front supporter 11 is mounted to a rear surface of the cabinet cover 4, to rotatably support a front end of the drum 10.

A rear supporter 12 is mounted to a front surface of the back panel 7, to rotatably support a rear end of the drum 10. A communicating hole 13 is formed through the rear supporter 12, to communicate the suction passage 20 with an inlet of the drum 10, and thus enabling air emerging from the suction passage 20 to be introduced into the inlet of the drum 10.

As shown in FIGS. 2 and 3, the drum 10 has a cylindrical barrel structure forwardly and rearwardly opened to allow air to flow in forward and rearward directions while having a space to contain laundry. The drum 10 has a rear opening forming the inlet of the drum 10, and a front opening forming the outlet of the drum 10. In the drum 10, a lift 14 is mounted to an inner peripheral surface of the drum 10 such that the lift 14 is inwardly protruded, to raise laundry and then to allow the raised laundry to fall during rotation of the drum 10.

The suction passage 20 is defined by a suction duct having a lower end communicating with a rear end of the heater 30, and an upper end communicating with the communicating hole 13 of the rear supporter 12.

As shown in FIGS. 2 and 3, the heater 30 includes a heater case mounted on an upper surface of the base panel 2 while communicating with the suction passage 20, namely, the suction duct, and a heating coil arranged in the heater case. When electric power is supplied to the heating coil, the heater case and the interior of the heater case are heated. As a result, air passing through the interior of the heater case is heated, so that it becomes hot air having low humidity.

As shown in FIGS. 2 and 3, the exhaust passage 40 is defined by a lint duct 42, a fan housing 44, and an exhaust pipe 46. The lint duct 42 is arranged to communicate with the outlet of the drum 10, in order to allow air from the drum 10 to be exhausted. A lint filter 41 is arranged in the lint duct 42, to filter out foreign matter, such as lint, from the exhausted air. The fan housing 44 communicates with the lint duct 42. The blowing fan 43 is arranged in the fan housing 44. The exhaust pipe 46 has one end communicating with the fan housing 44, and the other end extending outwardly through the cabinet 1. The external exhaust duct 50 is connected to the exhaust pipe 46, to guide the air outwardly exhausted from the cabinet 1 to the outdoors. The external exhaust duct 50 is formed at the outside of the cabinet 1, in order to guide air to the outdoors. The external exhaust duct 50 may extend through the building inner wall 60.

An air passage used in the present invention includes the suction passage 20, the inner space of the drum 10, the exhaust passage 40, and the external exhaust duct 50. Clogging of the air passage occurs mainly at the lint filter 41 of the exhaust passage 40 and in the external exhaust duct 50. The influence of the air flow interference caused by the clogging of the lint filter 40 in the exhaust passage 40 is relatively small, as compared to the influence of the air flow interference caused by the clogging of the external exhaust duct 50.

Hereinafter, operation of the exhaustion type dryer according to the illustrated embodiment of the present invention will be described.

The user closes the door 6 after loading laundry into the drum 10, and then operates the control panel 9, in order to operate the exhaustion type dryer. In accordance with the operation of the exhaustion type dryer, the heater 30 is turned on, and the motor 72 is driven.

When the heater 30 is in an ON state, it heats the interior thereof. As the motor 72 is driven, the blowing fan 43 and a belt 70 are rotated. In accordance with the rotation of the belt 70, the drum 10 is rotated. As a result, the laundry loaded in the drum 10 repeats operations of being raised by the lift 14, and then dropped.

During the rotation of the blowing fan 43, ambient air around the cabinet 1 is sucked into an air suction hole 7*a* formed through the back cover 7 by a blowing force generated in accordance with the rotation of the blowing fan 43. The sucked air is then guided between the cabinet 1 and the drum 10. The air introduced between the cabinet 1 and the drum 10 is introduced into the heater 30 which, in turn, heats the introduced air. As the air is heated, it comes into a state of high temperature and low humidity. Subsequently, the heated air is introduced into the drum 10 via the suction passage 20 and the communicating hole 13 of the rear supporter 12.

The hot and low-humid air introduced into the drum 10 comes into contact with the laundry as it flows forwardly in the drum 10, so that it comes into a high humid state. Thereafter, the air is introduced into the exhaust passage 40.

The air introduced into the exhaust passage 40 is guided by the exhaust pipe 46 such that it is outwardly exhausted through the external exhaust duct 50.

FIG. 4 is a circuit configuration of the dryer, to which a clogging degree deciding method according to the present invention is applied. The dryer shown in FIG. 4 includes first and second thermostats TS1 and TS2, each of which receives external commercial power, and supplies the received commercial power to the heater 30. Each of the first and second thermostats TS1 and TS2 is turned on/off in accordance with the temperature of the heater 30 or the temperature of air heated by the heater 30. In the following description, the first and second thermostats may also be simply referred to as "temperature control members". The dryer also includes a switch SW turned on/off in accordance with a control command from a microcomputer 90, to selectively apply the commercial power to the heater 30. The input unit 9*a*, display unit 9*b*, heater 30, blowing fan 43, and motor 70 are also included in the dryer. The dryer further includes a detecting circuit 80 for detecting whether or not power is supplied to the heater 30, in accordance with the ON/OFF states of the first and second thermostats TS1 and TS2. The microcomputer 90, which is also included in the display device, determines whether or not the first and second thermostats TS1 and TS2 are in an ON state, based on the power supply ON/OFF state detected by the detecting circuit 80. Although not shown, a power supply is also provided to supply DC power converted from the commercial power to the microcomputer 90, input unit 9*a*, and display unit 9*b*. The power supply is well known by those skilled in the technical field to which the present invention pertains.

The first and second thermostats TS1 and TS2 function as controllers operating in accordance with temperature. The first and second thermostats TS1 and TS2 are mounted at one side of the heater 30 or in the vicinity of the heater 30. The first and second thermostats TS1 and TS2 respond to the temperature of the heater 30 or the temperature of air heated by the heater 30. Each of the first and second thermostats TS1 and TS2 is maintained in an ON state until it senses a predetermined overheating temperature. When the first or second thermostat TS1 or TS2 senses a temperature exceeding the predetermined overheating temperature, it is transited to an OFF state, thereby cutting off the supply of the commercial power to the heater 30. In particular, once the first thermostat TS1 is transited to an OFF state, it does not return to an ON state, in order to assist the second thermostat TS2. The first and second thermostats TS1 and TS2 are mounted to, for example, the suction passage 20 connected to the heater 30.

The switch SW is constituted by an element such as a relay. The switch SW is maintained in an ON state during a drying operation in accordance with an ON-control operation of the microcomputer 90, while being maintained in an OFF state in accordance with an OFF-control operation of the microcomputer 90.

The input unit 9*a* receives control commands input from the user in association with the drying operation, and applies the control commands to the microcomputer 90.

The display unit 9*b* displays the control commands input from the user in association with the drying operation, the drying operation progress, the residual drying time, the clogging degree of the air passage, the clogged position, etc. In the present invention, the air passage includes the suction passage 20, the inner space of the drum 10, the exhaust passage 40, and the external exhaust duct 50. In particular, the air passage may designate the lint filter 41 of the exhaust passage 40 and the external exhaust duct 50.

The detecting circuit 80 is connected to nodes N1 and N2, to detect whether or not current flows through a DC circuit including the heater 30, namely, whether or not power is supplied to the heater 30. For this determination, the detecting circuit 80 is connected to the nodes N1 and N2 by connecting lines 80*a* and 80*b*, respectively. The detecting circuit 80 is mounted on the control panel 9, on which the microcomputer 90 is also mounted. Accordingly, the connecting lines 80*a* and 80*b* extend along the inner space between the drum 10 and the cabinet body 3 or along the inner surface of the cabinet body 3.

In detail, the detecting circuit 80 detects whether or not power is supplied to the heater 30 in accordance with ON/OFF operations of the first and second thermostats TS1 and TS2 responding to the temperature of the heater 30 or the temperature of air heated by the heater 30. Of course, the supply of power to the heater 30 is also controlled by the switch SW. However, the switch SW operates under the control of the microcomputer 90. Accordingly, the microcomputer 90 determines whether or not power is supplied to the heater 30, based on a detect signal from the detecting circuit 80, in an ON state of the switch SW. When the switch SW is in an OFF state under the control of the microcomputer 90, the microcomputer does not take into consideration the detect signal from the detecting circuit 80.

The detecting circuit 80 sends a detect signal corresponding to a power supply or cutoff state to the microcomputer 90, so as to enable the microcomputer 90 to identify the power supply or cutoff state, based on the detect signal. Different from the circuit configuration shown in FIG. 4, the detecting circuit 80 may have input terminals respectively connected between the first thermostat TS1 and a commercial power source and between the heater 30 and the switch SW. In the case of a DC circuit including the first and second thermostats TS1 and TS2, heater 30, and switch SW, it is possible to most clearly identify the voltage difference generated across the heater 30 when commercial power is supplied. Accordingly, the connection of the detecting circuit 80 is achieved to always detect a voltage difference generated in a circuit including the heater 30.

As described above, the microcomputer 90 basically controls the heater 30, switch SW, and motor 72 in accordance with a command input from the user through the input unit 9*a*, and controls the blowing fan 43 in accordance with the control for the motor 72, for the execution of a desired drying operation. The microcomputer 90 is also equipped with a storage (not shown) to store a control algorithm for the above-described control operations. For the storage, for example, an EEPROM may be used.

The microcomputer 90 and detecting circuit 80 are mounted to a back surface of the above-described control panel 9.

The microcomputer 90 also determines information as to the power supply or cutoff carried out by the first and second thermostats TS1 and TS2 in accordance with the detect signal from the detecting circuit 80.

FIG. 5 illustrates an exemplary embodiment of the detecting circuit shown in FIG. 4. As shown in FIG. 5, the detecting circuit 80 includes a diode D1 for passing a positive (+) component of an input voltage from the node N1, a resistor R1 for reducing the input voltage from the node N1, and a photocoupler PC to turn on/off in accordance with the input voltage. The detecting circuit 80 also includes a diode D2 and a capacitor C1 to prevent noise components of the input voltage from being applied to input terminals 11 and 12 of a photocoupler PC. The detecting circuit 80 further includes a resistor R2 and a capacitor C2, which are connected to an output terminal O1 of the photocoupler PC, to provide, to the microcomputer 90, a DC voltage lower than a reference voltage Vref in accordance with an ON or OFF state of the photocoupler PC. The DC voltage has different waveforms respectively corresponding to the ON and OFF states of the photocoupler PC. The reference voltage Vref is used as a drive voltage for the microcomputer 90 in the circuit, which includes the microcomputer 90. Although no description will be given of a voltage source for generating the reference voltage Vref, this voltage source is well known by those skilled in the technical field to which the present invention pertains.

Where the commercial power has a voltage of, for example, AC 240V, the voltage difference between the node N1 and the node N2. When this voltage is directly applied to the photocoupler PC, the photocoupler PC may be damaged. To this end, the resistor R1 is used to reduce the input voltage to a several ten V.

When there is a voltage difference between the node N1 and the node N2, namely, when the first and second thermostats TS1 and TS2 turn on to enable power to be supplied to the heater 30, a voltage corresponding to the voltage difference is applied to the input terminals 11 and 12 of the photocoupler PC. Since the applied voltage is an AC voltage, a photodiode, which is included in the photocoupler PC, as a light emitter, periodically emits light in accordance with the cycle of the voltage. Accordingly, a transistor, which is also included in photocoupler PC, as a light receiver, is periodically turned on/off. As a result, a square wave is applied to the microcomputer 90. On the other hand, when there is no voltage difference between the node N1 and the node N2, namely, when the first and second thermostats TS1 and TS2 turn off to prevent power from being supplied to the heater 30, the input terminals 11 and 12 of the photocoupler PC are maintained at the same voltage level. The photodiode of the photocoupler PC does not emit light, so that the transistor of the photocoupler PC is maintained in an OFF state. As a result, a DC voltage waveform approximate to the reference voltage Vref is continuously applied to the microcomputer 90.

FIGS. 6 and 7 are graphs depicting output waveforms of the detecting circuit, respectively. When the first and second thermostats TS1 and TS2 are in an ON state, the commercial power, which has an AC voltage, is applied to the heater 30. Accordingly, a voltage difference corresponding to the AC voltage of the commercial power is generated between the node N1 and the node N2. In accordance with this voltage difference, the photocoupler PC is turned on. Due to the AC voltage, however, the photocoupler PC is repeatedly turned on and off in accordance with the cycle of the commercial power. As a result, a square wave lower than the reference voltage Vref is applied to the microcomputer 90, as shown in FIG. 6.

On the other hand, when the first and second thermostats TS1 and TS2 are in an OFF state, no power is supplied to the heater 30. Accordingly, the nodes N1 and N2 are maintained at the same voltage level, so that the photocoupler PC is maintained in an OFF state. As a result, a DC voltage (for example, a high signal) approximate to the reference voltage Vref is continuously applied to the microcomputer 90, as shown in FIG. 7.

Thus, the microcomputer 90 can calculate the time, for which the power supply to the heater 30 is cut off in accordance with the OFF state of the first and second thermostats TS1 and TS2, based on the waveform of the DC voltage applied to the microcomputer 90.

FIG. 8 depicts waveforms of detect signals recognized by the microcomputer. In FIG. 8, "R" represents the diameter of the exhaust duct 50, and the unit of the diameter R is in inches. The waveforms of FIG. 8 represent detect signals generated from the detecting circuit 80, as shown in FIG. 6 or 7, and recognized by the microcomputer as power supply/cutoff state information, namely, ON/OFF information, for diameters of R(2.0), R(2.3), R(2.625), R(2.88), and R(3.0), respectively. Referring to FIG. 8, it can be seen that the air flow interference (clogging degree) in the air passage is lower at a larger diameter, and is higher at a smaller diameter.

In order to determine the clogging degree of the air passage, a determination method using a power supply ON/OFF duty ratio is used in accordance with the present invention. In the illustrated embodiment, one or either of an ON duty ratio (x'/y') or an OFF duty ratio (z'/y') may be used. The following description will be given in conjunction with the OFF duty ratio (z'/y').

The OFF duty ratio of the case "R(2.0)" is 0.48 (ON duty ratio is 0.52), the OFF duty ratio of the case "R(2.3)" is 0.32 (ON duty ratio is 0.68), the OFF duty ratio of the case "R(2.625)" is 0.26 (ON duty ratio is 0.74), the OFF duty ratio of the case "R(2.88)" is 0.13 (ON duty ratio is 0.87), and the OFF duty ratio of the case "R(3.0)" is 0 (ON duty ratio is 1). That is, it can be seen that the OFF duty ratio increases as the diameter decreases. On the other hand, the ON duty ratio decreases. Thus, the microcomputer 90 can determine the clogging degree of the air passage (in particular, the clogging degree of the lint filter 41 or exhaust duct 50) by calculating the OFF duty ratio. Results of an experiment measuring the clogging degree of the air passage are described in the following Table 1.

TABLE 1

| OFF Duty Ratio | Clogging Degree | Clogging Position |
|---|---|---|
| 0 to 0.30 | — | — |
| 0.30 to 0.45 | Low (Slight) | Lint filter |
| 0.45 to 0.60 | Medium (Medium) | Lint filter (severely clogged)/Exhaust duct (medially clogged) |
| 0.60 or more | High (Severe) | Exhaust Duct |

The microcomputer 90 stores air passage clogging information acquired based on the above-described ON/OFF duty ratio. The storing operation is repeatedly carried out in accordance with the number of drying operations carried out in the dryer 1. In particular, when the dryer 1 is initially installed, or is re-installed due to house-moving or other reasons, the microcomputer 90 initially stores an initial clogging degree of the air passage, more accurately, an initial clogging degree of the exhaust duct 50, and additionally stores a clogging degree according to a subsequent drying operation whenever the drying operation is carried out. For example, the microcomputer 90 stores a value D0 as an initial clogging degree, and values D1, D2, . . . , Dn−1, and Dn as subsequent clogging degrees.

FIG. 9 is a graph depicting a variation in clogging degree depending on a variation in the diameter of the exhaust duct and a variation in the number of use times of the dryer.

As shown in FIG. 9, the ON duty ratio, which is a reference for the calculation of the initial clogging degree, is varied in accordance with a variation in the diameter R (in inches) of the exhaust duct 50 (for example, "D0'" and "D0'"). Referring to FIG. 9, it can also be seen that the clogging degree of the air passage increases gradually in accordance with an increased number of drying operations in the dryer, N. Generally, the clogging degree of the exhaust duct 50 is not considerably varied at a small number of drying operations N. In the same condition, however, the lint filter 41 exhibits an abruptly-increased clogging degree. For example, when the diameter R of the exhaust duct 50 is 2.5 inches, the difference "d" between the initial clogging degree D0' and the current clogging degree D8 at the number of drying operations corresponding to "8" may be generally similar to the clogging degree of the lint filter 41. Of course, when this difference "d" is relatively large, and a variation in the difference "d" is severe, the clogging degree of the exhaust duct 50 may mean a variation in the environment around the exhaust duct 50 caused by, for example, house-moving.

FIG. 10 is a graph depicting a variation in the clogging degree of the lint filter depending on a variation in the diameter of the exhaust duct. Referring to FIG. 10, it can be seen that the ON duty ratio difference between the graph S1 of the lint filter 41 corresponding to a non-clogged state and the graph S2 of the lint filter 41 corresponding to a clogged state is varied in accordance with a variation in the diameter (namely, the initial clogging degree) of the exhaust duct 50. That is, the filter-clogging reference duty ratio R1' of the lint filter 41 in an ON duty ratio range of R1 to R2, the filter-clogging reference duty ratio R2' of the lint filter 41 in an ON duty ratio range of R2 to R3, and the filter-clogging reference duty ratio R3' of the lint filter 41 in an ON duty ratio range of more than R3 are different from one another. Therefore, one of the filter-clogging reference duty ratios R1', R2', and R3' selected in accordance with the initial clogging degree is used to accurately determine the clogging state or clogging degree of the lint filter 41.

The microcomputer 90 stores filter-clogging reference duty ratios respectively corresponding to a plurality of initial clogging degrees, in the form of a look-up table.

FIG. 11 is a graph depicting a variation in the clogging degree calculated based on a variation in the applied voltage. As shown in FIG. 11, when the voltage applied to the dryer 1 is varied from a low voltage level to a high voltage level in an arrow direction, the ON duty ratio calculated by the microcomputer 90 is varied even when the diameter of the air passage (namely, the clogging degree or initial clogging degree of the air passage) is constant (for example, R(2.0) or R(2.625)). That is, the first thermostat TS1 or second thermostat TS2 is more frequently turned off at a high voltage level than at a low voltage level. Since the amount of heat generated from the heater 30 depends on the applied voltage, it is small at a voltage level lower than a rated voltage, while being large at a voltage level higher than the rated voltage. Due to such a phenomenon, the ON duty ratio at a low voltage level is higher than the ON duty ratio at a rated voltage level, even when the clogging degree of the air passage is constant. On the other hand, the ON duty ratio at a high voltage level is lower than the ON duty ratio at the rated voltage level. For this reason, the microcomputer 90 erroneously determines the clogging state of the air passage.

For example, if it is assumed that an ON duty ratio of more than B corresponds to a normal state of the air passage, namely, a non-clogged state of the air passage, an ON duty ratio of not less than A, but not more than B, corresponds to a medially-clogged state of the air passage, and an ON duty ratio of less than A corresponds to a severely-clogged state of the air passage, the clogging degree of the air passage may be erroneously determined in accordance with a variation in the applied voltage in the case of R(2.625).

For this reason, if fixed ON/OFF duty ratios as described in Table 1 are used as reference values, under the condition in which there is a variation in the applied voltage, it is difficult to accurately determine the clogging degree or clogging state (clogging progress) of the air passage. In order to solve this problem, characteristics shown in FIG. 12 are simultaneously or sequentially applied to the determination.

FIG. 12 is a graph depicting a variation in average OFF time depending on a variation in the diameter of the exhaust duct. As shown in FIG. 12, the average OFF time approximately corresponds to the diameter R (initial clogging degree). The average OFF time can be calculated by summing all OFF times z' shown in FIG. 8, and dividing the resultant sum by the number of OFF operations.

As shown in FIG. 12, when the diameter is not less than "E", the average OFF time is reduced as the diameter increases. Accordingly, the microcomputer 90 can determine the diameter, namely, the clogging degree of the air passage, in accordance with the average off time. In particular, the average OFF time of the temperature control member exhibits characteristics insensible to a voltage variation because it is not influenced by the heater 30. Accordingly, the average OFF time of the temperature control member can be used as data for accurately determining the clogging degree or clogging state of the air passage, even in an environment involving a voltage variation. The average OFF time of the temperature control member increases as the clogging degree of the air passage increases. This is because the temperature control member is more slowly cooled as the amount of air introduced into the air passage decreases, while being more rapidly cooled as the amount of the introduced air increases. Also, the average ON time corresponding to the average OFF time may be used.

Of course, even when the average OFF time is used, there may be a range where the average OFF time is reduced even when the diameter decreases, in the case in which the diameter is not more than E. In the range of E or less, the air passage may have a non-constant diameter (clogging degree) even at the same average OFF time, as compared to the range of more than "E". For this reason, the microcomputer 90 erroneously determines the diameter in the range of E or less, when the determination is made, only based on the average OFF time. For example, when the average OFF time is "F", the clogging degree of the air passage may be determined to be a diameter "D" or a diameter "D'".

Therefore, the microcomputer 90 should determine the clogging degree or clogging state of the air passage by simultaneously or sequentially using the ON/OFF duty ratio and average OFF time.

FIG. 13 is a main flow chart of a clogging degree deciding method for the dryer according to the present invention.

In detail, at step S11, the microcomputer 90 determines whether or not there is an initial clogging degree of the air passage detected and stored by the microcomputer 90. If there is a stored initial clogging degree of the air passage, the microcomputer 90 proceeds to step S12. If not, the microcomputer 90 proceeds to step S13.

At step S12, the microcomputer 90 determines whether or not the difference between the finally-stored two of the stored clogging degree D0 to Dn, namely, the clogging degrees Dn and Dn−1, is more than a filter-clogging determination reference value Dr. If the clogging degree difference is more than the filter-clogging determination reference value Dr, the microcomputer proceeds to a routine A. The difference between the clogging degrees Dn and Dn−1 means that the current clogging degree of the lint filter 41 is severer than the previous clogging degree. Accordingly, when difference between the clogging degrees Dn and Dn−1 is more than the filter-clogging determination reference value Dr, it is necessary to more accurately determine the clogging degree or clogging state of the lint filter 41. In this case, therefore, the microcomputer 90 proceeds to the routine A. The routine A will be described later in detail.

At step S13, the microcomputer 90 calculates an average OFF time of the temperature control member during the drying operation or after the completion of the drying operation. When it is determined that the calculated average OFF time is more than a first reference value G (FIG. 12), the microcomputer 90 proceeds to step S14. On the other hand, if the calculated average OFF time is not more than the first reference value G, the microcomputer 90 proceeds to step S16.

When it is determined at step S14 that the calculated average OFF time is more than a second reference value F, the microcomputer 90 proceeds to step S15. If not, the microcomputer 90 proceeds to step S18.

At step S15, the microcomputer 90 determines that the clogging degree of the air passage (exhaust duct 50) is severe because the calculated average OFF time is more than the second reference value F. Accordingly, the microcomputer 90 displays the clogging degree through the display unit 9*b*. That is, when the calculated average OFF time is more than the second reference value F, the microcomputer 90 determines that the clogging degree is severe, as shown in FIG. 12.

At step S16, the microcomputer 90 uses the ON duty ratio of the temperature control member because, when the calculated average OFF time is not more than the first reference value G, there may be no or little clogging, as shown in FIG. 12. Accordingly, the microcomputer 90 calculates the ON duty ratio, and compares the calculated ON duty ratio with a clogging reference value Cr for the exhaust duct 50 (for example, 0.40). When the calculated ON duty ratio is less than the clogging reference value Cr, the microcomputer 90 determines that the clogging degree corresponds to a left portion of FIG. 12 (with respect to "E"). In this case, the microcomputer 90 proceeds to step S15. When the calculated ON duty ratio is not less than the clogging reference value Cr, the microcomputer 90 determines that the clogging degree corresponds to a right portion of FIG. 12 (with respect to "E"). In this case, the microcomputer 90 proceeds to step S17.

At step S17, the microcomputer 90 determines that the current clogging degree of the air passage is normal or low. In this case, the microcomputer 90 displays a normal or low clogging degree or clogging state through the display unit 9*b*.

At step S18, the microcomputer 90 uses the ON duty ratio of the temperature control member because, when the calculated average OFF time is not more than the second reference value F, there may be no or little clogging, as shown in FIG. 12. Accordingly, the microcomputer 90 calculates the ON duty ratio, and compares the calculated ON duty ratio with the clogging reference value Cr for the exhaust duct 50. When the calculated ON duty ratio is less than the clogging reference value Cr, the microcomputer 90 determines that the clogging degree corresponds to the left portion of FIG. 12 (with respect to "E"). In this case, the microcomputer 90 proceeds to step S19.

At step S19, the microcomputer 90 determines that the current clogging degree of the exhaust duct 50 corresponds to a diameter of not more than "D'". That is, the microcomputer 90 determines that the clogging degree of the exhaust duct 50 is medium, and displays the results of the determination through the display unit 9*b*.

At step S20, the microcomputer 90 stores the clogging degree of the exhaust duct 50 determined through steps S13 to S19. This clogging degree is included in the above-described information as to the clogging of the air passage.

When various average OFF times and various ON/OFF duty ratios are used in the procedure shown in the above flow chart, it is possible to determine and display the clogging degree of the exhaust duct 50 at various levels.

FIG. 14 is a sub flow chart of FIG. 13.

In detail, at step S31, the microcomputer 90 reads the stored information as to the clogging of the air passage.

At step S32, the microcomputer 90 reads an initial clogging degree from the clogging information, and reads a filter-clogging reference duty ratio corresponding to the read initial clogging degree.

At step S33, the microcomputer 90 compares the difference between the initial clogging degree D0 and the current clogging degree Dn with the filter-clogging reference duty ratio. If the clogging degree difference is more than the filter-clogging reference duty ratio, the microcomputer 90 proceeds to step S34. If not, the microcomputer 90 proceeds to step S35.

At step S34, the microcomputer 90 determines that the lint filter 41 is in a clogged state, and displays the results of the determination through the display unit 9*b*.

At step S35, the microcomputer 90 determines that the lint filter is in a non-clogged state, namely, a normal state, and displays the results of the determination through the display unit 9*b*.

When various filter clogging reference duty ratios are used in the procedure shown in the above flow chart, it is possible to finely divide the clogging degree range of the lint filter, and thus to provide a more-accurately-determined clogging degree of the lint filter 41 to the user.

Although the present invention has been described in conjunction with the above-described embodiments and the accompanying drawings, it is not limited to such embodiments and drawings.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As apparent from the above description, the present invention provides an effect capable of more accurately determining the clogging degree of an air passage.

The present invention also provides capable of identifying information as to the current clogging state of an air passage and a clogged portion of the air passage, and displaying the information while providing the information to the user.

The present invention also provides an effect capable of deciding the clogging degree of the dryer in accordance with the execution of a drying operation or a variation in environment such as house-moving or cleaning.

Also, the present invention provides an effect capable of accurately determining the clogging degree of an air passage even when the environment around the dryer varies, for example, even when power applied to the dryer varies.

What is claimed is:

1. A clogging degree deciding method for a dryer, comprising:

reading information as to clogging of an air passage; and displaying, on a display unit, information indicative of a clogging degree of an exhaust duct or a clogging degree of a filter in accordance with the read clogging information, wherein the clogging information comprises an ON/OFF duty ratio of a temperature control member, and wherein the displaying comprises:

(a) comparing a difference between two ON/Off duty ratios stored with a filter-clogging determination reference value, the two ON/OFF duty ratios corresponding to different points in time over operation of the dryer; and (b) determining the clogging degree based on a result of the comparison, the clogging degree providing an indication of interference of air flow through the air passage by an obstruction within or affecting flow of air in the air passage, said method further comprising:

determining a clogging location based on the OFF duty ratio of the temperature control member, the clogging location corresponding to a lint filter when the OFF duty ratio falls within a first range and the clogging location corresponding to the exhaust duct when the OFF duty ratio falls within a second range.

2. The clogging degree deciding method according to claim 1, further comprising: calculating the ON/OFF duty ratio of the temperature control member during a drying operation.

3. The clogging degree deciding method according to claim 2, wherein the clogging information further comprises an initial clogging degree of the exhaust duct; and wherein determining the clogging degree of the filter comprises:

comparing the calculated ON/OFF duty ratio difference with a filter-clogging reference duty ratio corresponding to the initial clogging degree, and determining the clogging degree of the filter based on a result of the comparison.

4. The clogging degree deciding method according to claim 1, further comprising: determining the clogging degree of the exhaust duct.

5. The clogging degree deciding method according to claim 4, wherein of determining the clogging degree of the exhaust duct is executed when there is no information stored as to clogging of the exhaust duct.

6. The clogging degree deciding method according to claim 4, wherein of determining the clogging degree of the exhaust duct comprises:

calculating an average ON/OFF time of the temperature control member during a drying operation of the dryer; and primarily comparing the calculated average ON/OFF time with at least one of first and second reference values.

7. The clogging degree deciding method according to claim 6, wherein determining the clogging degree of the exhaust duct comprises:

calculating the ON/OFF duty ratio of the temperature control member, based on a result of the primary comparison; and secondarily comparing the calculated ON/OFF duty ratio with a clogging determination reference value for the exhaust duct.

8. A clogging degree deciding method for a dryer, comprising:

staring a drying operation;

calculating an average ON/OFF time of a temperature control member during the drying operation;

calculating an ON/OFF duty ratio of the temperature control member during the drying operation when the calculated ON/OFF time is within a predetermined range;

determining a clogging degree of an air passage based on the calculated ON/OFF duty ratio;

determining the clogging degree of the air passage based on the calculated ON/OFF time, when the calculated ON/OFF time is outside the predetermined range; and displaying information on a display unit indicative of the clogging degree, wherein the clogging degree provides an indication of interference of air flow through the air passage by an obstruction within or affecting flow of air in the air passage, and wherein a clogging location is determined based on the OFF duty ratio of the temperature control member, the clogging location corresponding to a lint filter when the OFF duty ratio falls within a first range and the clogging location corresponding to the exhaust duct when the OFF duty ratio falls within a second range.

9. The clogging degree deciding method according to claim 8, wherein the clogging degree of the air passages corresponds to about a clogging degree of an exhaust duct.

10. The clogging degree deciding method according to claim 8, further comprising: displaying the clogging degree of the air passage.

* * * * *